US009968499B2

(12) United States Patent
Davis

(10) Patent No.: US 9,968,499 B2
(45) Date of Patent: May 15, 2018

(54) PULMONARY PRONE BED

(71) Applicant: Kevin R. Davis, Beverly Hills, CA (US)

(72) Inventor: Kevin R. Davis, Beverly Hills, CA (US)

( * ) Notice: Subject to any disclaimer, the term of this patent is extended or adjusted under 35 U.S.C. 154(b) by 239 days.

(21) Appl. No.: 14/489,382

(22) Filed: Sep. 17, 2014

(65) Prior Publication Data

US 2016/0074264 A1 Mar. 17, 2016

(51) Int. Cl.

| | |
|---|---|
| ***A61G 13/00*** | (2006.01) |
| ***A47G 19/04*** | (2006.01) |
| ***A61G 7/002*** | (2006.01) |
| ***A61G 7/015*** | (2006.01) |
| ***A61G 7/07*** | (2006.01) |
| ***A61G 7/05*** | (2006.01) |
| ***A47G 9/10*** | (2006.01) |

(52) U.S. Cl.

CPC ..... *A61G 7/015* (2013.01); *A47G 9/1054* (2013.01); *A61G 7/05* (2013.01); *A61G 7/072* (2013.01); *A61G 2200/325* (2013.01)

(58) Field of Classification Search

CPC ..... A61G 7/00; A61G 7/002; A61G 7/005; A61G 7/07; A61G 7/015; A61G 7/1084; A61G 13/08; A61G 13/121; A61G 2200/325; A61G 2200/327; A47C 17/00; A47C 17/64; A47C 17/66; A47C 19/04; A47C 20/02; A47C 19/026; A47G 9/1054

See application file for complete search history.

(56) References Cited

U.S. PATENT DOCUMENTS

| | | | | |
|---|---|---|---|---|
| 3,926,181 | A * | 12/1975 | Eischen, Sr. | A47G 9/10 5/632 |
| 5,072,463 | A * | 12/1991 | Willis | A61G 7/005 5/616 |
| 5,996,145 | A * | 12/1999 | Taylor | A47C 19/005 5/184 |
| 6,202,230 | B1 * | 3/2001 | Borders | A61G 13/0009 5/613 |
| 7,441,291 | B2 * | 10/2008 | Hayes | A47C 20/08 5/617 |
| 7,730,562 | B2 * | 6/2010 | Hornbach | A47C 19/045 5/185 |

(Continued)

*Primary Examiner* — David E Sosnowski
*Assistant Examiner* — Rahib T Zaman
(74) *Attorney, Agent, or Firm* — Womble Bond Dickinson (US) LLP

(57) ABSTRACT

A pulmonary prone bed is described that reduces the frequency of Hospital-Acquired Pneumonia (HAP) by allowing a patient to rest/sleep in the prone position. In particular, a portion of a mattress and bed frame that supports the upper part of the body may adjust to the length of the torso of each individual patient and a midsection of the mattress and bed frame may adjust to the length of the thighs of each individual patient. This adjustment allows the chin of each patient to reach over the end of the mattress and the bed to fold downward at the patient's waist. By allowing the patient to rest in the prone position, gravity may work to pull mucous secretions forward and out the nose to be expelled. In this fashion, mucous secretions will be nowhere near the lungs such that the patient may not be susceptible to aspiration of mucous secretions.

19 Claims, 2 Drawing Sheets

(56) References Cited

U.S. PATENT DOCUMENTS

| | | | | |
|---|---|---|---|---|
| 8,056,163 | B2 * | 11/2011 | Lemire | A61G 7/001 5/610 |
| 8,474,074 | B2 | 7/2013 | O'Keefe et al. | |
| 8,708,406 | B1 | 4/2014 | Powell et al. | |
| 2012/0246826 | A1 * | 10/2012 | Jin | A47C 19/04 5/400 |
| 2013/0007961 | A1 * | 1/2013 | Noh | A61H 39/04 5/638 |
| 2013/0245395 | A1 * | 9/2013 | Bidarian Moniri | A47C 20/026 600/301 |
| 2013/0305455 | A1 * | 11/2013 | Davis | A61G 7/07 5/632 |
| 2014/0053337 | A1 * | 2/2014 | Mac Marbury, III | A47G 9/1054 5/638 |
| 2014/0246064 | A1 * | 9/2014 | Swanson | A47C 29/003 135/121 |
| 2014/0259415 | A1 * | 9/2014 | Serhan | A61G 7/002 5/613 |

* cited by examiner

PULMONARY PRONE BED

FIELD

A pulmonary prone bed is disclosed that reduces the frequency of Hospital-Acquired Pneumonia (HAP) by allowing a patient to rest/sleep in the prone position. Other embodiments are also described.

BACKGROUND

Hospital-Acquired Pneumonia (HAP), also known as nosocomial pneumonia, is a common cause of death among patients suffering from nosocomial infections and is the primary cause of death in intensive care units. A cause of HAP is thought to be aspiration of microscopic drops and/or macroscopic amounts of nose and throat secretions. Accordingly, HAP may ultimately be caused by diminished lung volumes due to decreased clearance of secretions.

Medical literature misses an important point which may be responsible for the failure to address this problem. In particular, the issue is treated as though it were an unavoidable hazard of breathing while in a hospital. However, mucous is not produced in or near the lungs. Instead, mucous is produced in the sinus cavities of the head of a patient. The mucous must thereafter travel down the back of the sinuses into the throat and into proximity with the lungs before those microscopic drops can be aspirated into the lungs as the patient draws breath. This aspiration happens because patients in hospitals invariably lie supine (i.e., on their backs) in their beds. In that position, gravity is constantly at work to bring nasal secretions down the back of the throat and into the lungs.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

A pulmonary prone bed is disclosed that reduces the frequency of Hospital-Acquired Pneumonia (HAP) by allowing a patient to rest/sleep in the prone position. By allowing the patient to sleep in the prone position (i.e., face down), gravity may work in their favor to pull mucous secretions forward and out the nose where it can be expelled. In this fashion, mucous secretions will be nowhere near the lungs such that the patient may not be susceptible to aspiration of mucous secretions.

Traditional beds are not configured for patients to sleep in the prone position such that mucous may be expelled through the patient's nose or mouth. Instead, traditional beds require patients who attempt to lie and sleep in the prone position to turn their heads sideways, which very quickly results in a stiff neck. Further, while in the prone position, patients must keep their back straight or even arched backwards slightly (if the mattress sags in the middle), which results in a back ache. However, in the pulmonary prone bed described herein, the portion of the mattress and bed frame that supports the upper part of the body may adjust to the length of the torso of each individual patient. This adjustment allows the chin of each patient to reach over the end of the mattress and the bed to fold downward at the patient's waist. This downward angle at the patient's waist allows the legs of the patient to bend forward to relieve pain or stress on the back of the patient. To support the patient's head, a head support pad may be provided that is two or three inches shallower than the depth of a mattress used for the body of patient. This shallower head support pad allows the patient's chin and face to project lower than the top of the body mattress. A facial hole may be cut into the center of the head support pad which allows the patient to breathe while the face of the patient is pressed into the pad. This facial hole may also allow the patient to open his/her eyes to allow the patient to perform one or more visual activities, including reading while in the prone position. This head support pad may be separate from the mattress such that the head support pad may be replaced or removed (i.e., removed for cleaning, disposal, or replaced with a different size pad).

Although described in relation to reducing the likelihood of HAP, the pulmonary prone bed described herein may also be used in other therapeutic/medical contexts. For example, some patients recovering from orthopedic injuries or procedures may benefit from resting in the prone position. Since the pulmonary prone bed described herein allows patients to rest more comfortably in the prone position in comparison to traditional beds, orthopedic patients may also benefit from the assistance provided by the pulmonary prone bed.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
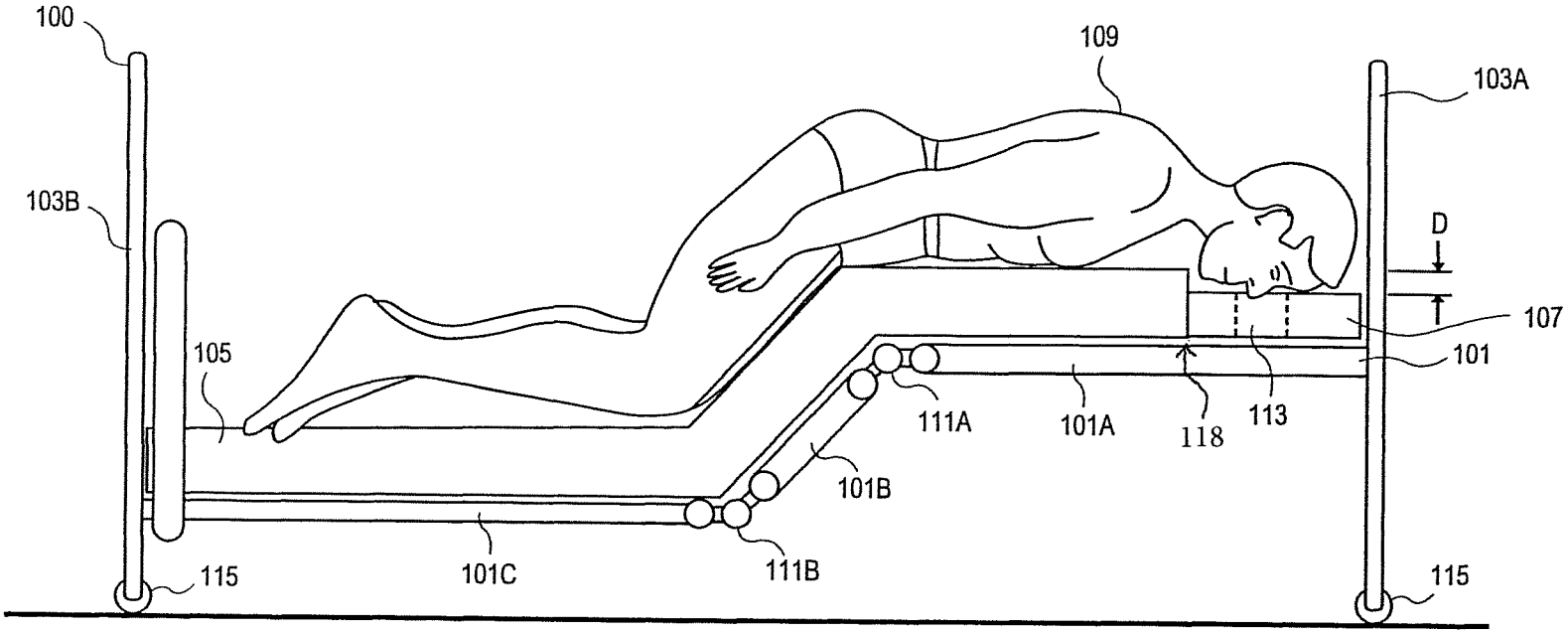
FIG. 1 shows a pulmonary prone bed according to one embodiment.

FIG. 1 shows a pulmonary prone bed 100 according to one embodiment. The pulmonary prone bed 100 may include a bed frame 101, a set of support legs 103A and 103B, a body mattress 105, and a head support pad 107. The bed frame 101 may be adjusted to meet the size and/or proportions of the body of a patient 109 as will be described in greater detail below. Each element of the pulmonary prone bed 100 will now be described by way of example.

The bed frame 101 may function as the support structure for the body mattress 105 and the head support pad 107. The bed frame 101 may be composed of multiple sections that allow the pulmonary prone bed 100 to adjust to the physical bodily dimensions or other needs of the patient 109. For example, as shown in FIG. 1, the bed frame 101 may include an upper section 101A, a middle section 101B, and a lower section 101C. Each of the sections 101A, 101B, and 101C of the bed frame 101 may be composed of various materials. For example, each of the sections 101A, 101B, and 101C may be composed of plastic polymers (e.g., polystyrene and polyvinyl chloride), woods (e.g., oak, pine, mahogany, walnut, and teak), elemental metals (e.g., aluminum), metal alloys (e.g., steel), or some combination of these materials. Although described as including three sections 101A, 101B, and 101C, in other embodiments the bed frame 101 may include more than three sections with corresponding joints 111A-B. However, for example purposes, the bed frame 101 will be described hereinafter as including three sections 101A, 101B, and 101C. Each of the sections 101A, 101B, and 101C will be described in greater detail below.

Figure 2:
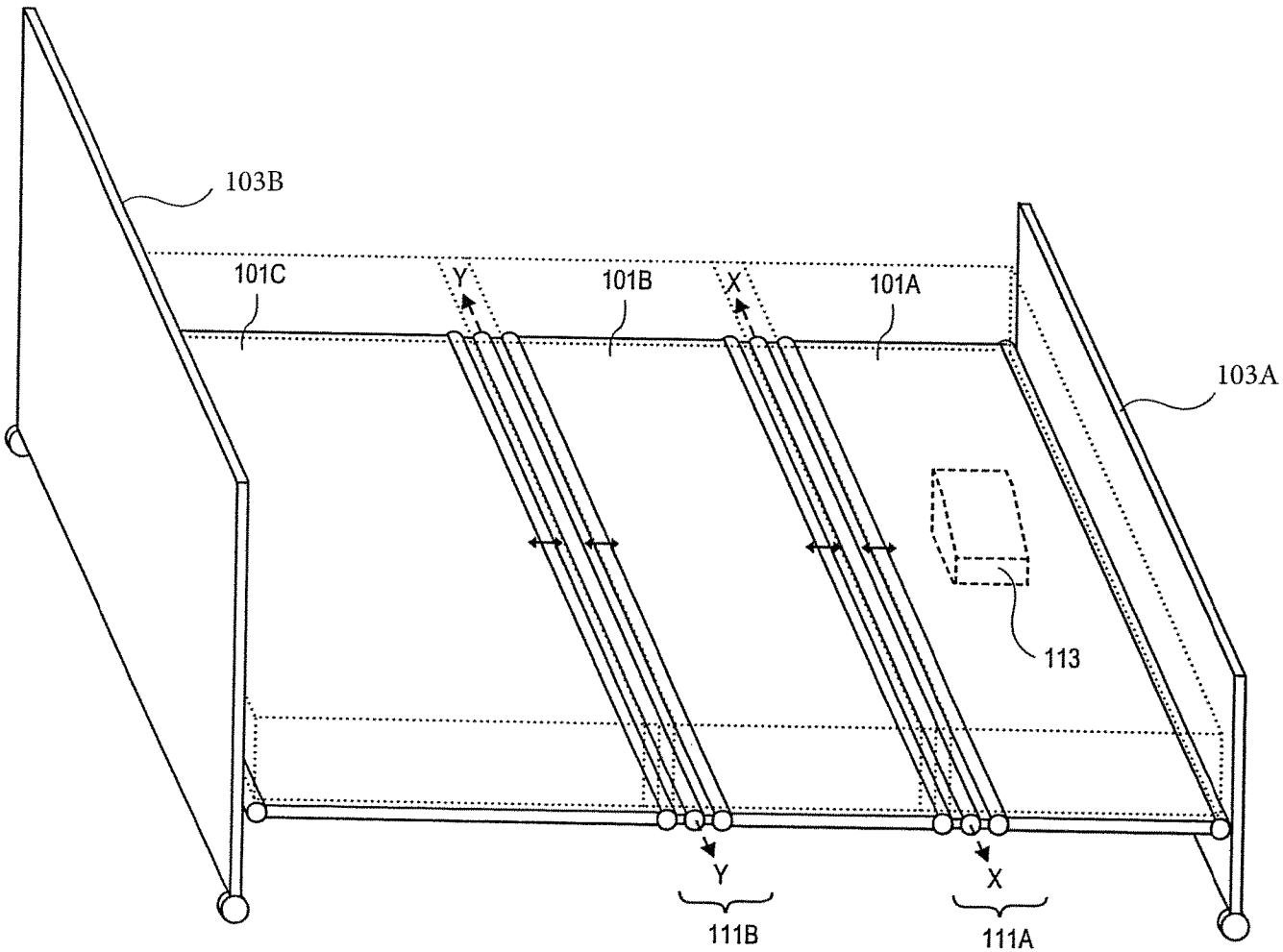
FIG. 2 shows a schematic view of a longitudinal expansion and retraction of a bed frame of the pulmonary prone bed according to one embodiment.

FIG. 2 shows an overhead view of the bed frame 101, including the upper section 101A, the middle section 101B, and the lower section 101C, according to one embodiment. As shown, the upper section 101A may be coupled to the middle section 101E at a first end of the middle section 101E using a joint 111A. Similarly, the lower section 101C may be coupled to the middle section 101E at a second end of the middle section 101E using a joint 111B. Accordingly, the middle section 101E may be coupled between the upper section 101A and the lower section 101C via the joints 111A and 111B, respectively. In this embodiment, the joints 111A and 111B may be expandable or retractable, thereby increasing or decreasing the size of the pulmonary prone bed 100 in multiple directions.

For example, the joint 111A may expand or contract along the direction of the arrows shown in FIG. 2. This expansion and contraction may be made separately on each side of the axis X. Similarly, the joint 111B may expand or contract along the direction of the arrows shown in FIG. 2. This expansion and contraction may be made separately on each side of the axis Y. Accordingly, the joints 111A and 111B may allow for both the expansion and contraction of the upper section 101A, the middle section 101B, and/or the lower section 101C to accommodate the dimensions of the patient 109. For example, a taller patient 109 may require a larger bed 100 in comparison to a shorter patient 109. Further, since the joints 111A and 111B allow for separate expansion and contraction of different sections 101A, 101B, and 101C of the bed frame 101, the changes in length of the bed 100 may be focused on particular areas of the patient 109. For example, the bed frame 101 may be expanded along the upper section 101A using the joint 111A to accommodate a larger upper torso of a patient 109 while the other sections 101B and 101C may remain unchanged or be altered in a different fashion to accommodate the lower half of the body of the patient 109.

In some embodiments, the joint 111A may be pivotable around the axis X while the joint 111B may be pivotable around the axis Y. By being pivotable around the axes X and Y, the upper section 101A may be raised relative to the lower section 101C and/or the lower section 101C may be raised relative to the upper section 101A. For example, as shown in FIG. 1, using the pivotable nature of the joints 111A and 111B, the lower section 101C may be placed at a first height while the upper section 101A may be placed at a second height, which is above the first height. In this example, the middle section 101E may be angled upward toward the higher upper section 101A. As shown, by providing adjustability in terms of the length, orientation, and height of the sections 101A, 101B, and 101C, the pulmonary prone bed 100 may fold at the waist of the patient 109 such that the lower legs of the patient 109 are resting on the lower section 101C and the upper torso of the patient 109 is resting on the upper section 101A. This configuration allows the legs of the patient 109 to bend forward to relieve pain or strain on the back of the patient 109 while the patient is lying prone on the bed 100.

In one embodiment, the body mattress 105 and/or the head support pad 107 may be placed on or coupled to the bed frame 101. The body mattress 105 may be padding that is used to cushion the bed frame 101 for the body of the patient 109 (e.g., all parts below the head of the patient 109, including torso and legs). The body mattress 105 may comprise a quilted or similarly fastened case made of a heavy cloth. The fastened case may contain hair, straw, cotton, foam rubber, and/or a framework of springs for cushioning the hard bed frame 101. In some embodiments, the body mattress 105 may be filled with air (e.g., inflatable) or water.

Similar to the body mattress 105, the head support pad 107 may be placed on or coupled to the bed frame 101. The head support pad 107 may cushion the bed frame 101 for the body of the patient 109 (e.g., all parts below the head of the patient 109). The head support pad 107 may comprise a quilted or similarly fastened case made of a heavy cloth. The fastened case may contain hair, straw, cotton, foam rubber, and/or a framework of springs for cushioning the hard bed frame 101. In some embodiments, the head support pad 107 may be filled with air (e.g., inflatable) or water.

In some embodiments, as shown in FIG. 1, the depth of the head support pad 107 may be less than the depth of the body mattress 105. This difference in depth may accommodate the chin and face of the patient 109 while the patient 109 is in the prone position on the bed 100. In particular, as will be described in greater detail below, the difference in depth may allow the head/face of the patient 109 to rest naturally on the head support pad 107 and without the need for patients 109 to bend or arch their neck.

In one embodiment, the head support pad 107 may include a facial hole 113 for assisting with breathing and vision. The facial hole 113 may connect a top surface of the head support pad 107 to a bottom surface of the head support pad 107. The facial hole 113 may allow the face (nose, mouth, and eyes) of the patient 109 to be exposed to air while the head/face of the patient 109 is pressed into the head support pad 107. Accordingly, the facial hole 113 prevents the patient 109 from having to turn his/her head to the side to breathe or to view an object (e.g., view a periodical). Accordingly, the facial hole 113 may assist the patient 109 to breathe and/or see while lying in the prone position. In one embodiment, the depth of the head support pad 107 may be defined as the distance between the top and bottom surfaces of the head support pad 107.

In some embodiments, the head support pad 107 may be part of the body mattress 105, while in other embodiments the head support pad 107 may be separate 118 from the body mattress 105. In these embodiments in which the head support pad 107 and the body mattress 105 are separate and distinct structures, multiple different sized and shaped head support pads 107 may be available for use with the pulmonary prone bed 100. In particular, head support pads 107 of different depths and with different sized facial holes 113 may be utilized based the physiology of the patient 109. Further, by being separate from the body mattress 105, the head support pad 107 may be easily removed for washing or disposal without requiring removal/disposal of the body mattress 105.

In one embodiment, the body mattress 105 and or the head support pad 107 may bend, expand, contract, or otherwise adjust with the bed frame 101. For example, the body mattress 105 and or the head support pad 107 may be attached to the bed frame 101 such that as the upper section 101A of the bed frame 101 expands or contracts, the body mattress 105 and or the head support pad 107 similarly expands or contracts. In this fashion, an end of the body mattress 105 nearest the head support pad 107 may be expanded or contracted until the chin of the patient 109 extends over the edge of the body mattress 105 and onto the head support pad 107. In this embodiment, the head support pad 107 may be thinner in comparison to the body mattress 105. For example, as shown in FIG. 1, the body mattress 105 may extend above the top surface of the head cushion 107 by a distance D. In this embodiment, the distance D may be between 1.0 inch and 3.0 inches. For example, the distance D may be 1.5 inches. By being depressed or having a smaller depth in relation to the body mattress 105, the head support pad 107 allows the chin and face of the patient 109 to project lower than the top of the body mattress 105. This configuration allows the head of the patient 109 to rest naturally on the pulmonary prone bed 100 in comparison to a traditional bed, which requires the head of the patient 109 to be held at the same level as the torso/chest of the patient 109 (potentially causing pain or stress to the neck of the patient 109).

In one embodiment, the bed frame 101 may be coupled to the support legs 103A and 103B as shown in FIG. 1. In particular, the upper section 101A may be coupled to the support legs 103A and the lower section 101C may be coupled to the support legs 103B using any combination of bolts, screws, clips, clamps, solder, etc. Each of the support legs 103A and 103B may extend across the upper section 101A and the lower section 101C, respectively, to support the bed frame 101, the body mattress 105, the head support pad 107, and the patient 109.

Each of the support legs 103A and 103B may include a set of wheels 115 that are located on the corners of the pulmonary prone bed 100. The wheels 115 may facilitate the movement of the pulmonary prone bed 100. For example, the wheels 115 allow a worker in a hospital to move the bed 100 within a building. Further, the wheels 115 may expand or contract the base of the bed 100 as the bed frame 101 expands/contracts. For instance, as the bed frame 101 contracts using the joints 101A and/or 101B, the wheels 115 may move the support legs 103A closer to the support legs 103B. Similarly, as the bed frame 101 expands using the joints 101A and/or 101B, the wheels 115 may move the support legs 103A farther from the support legs 103B. These movements may be precipitated by the movement of the individual elements of the bed frame 101 (i.e., contraction/expansion of one or more of the upper section 101A, the middle section 101B, and the lower section 101C).

As described above, a pulmonary prone bed 100 is described that allows a patient 109 to lie in the prone position (i.e., on the stomach/face of the patient 109) while increasing the ability of the patient 109 to breathe and remove nasal secretions through the nose or mouth of the patient 109. In particular, the head of the patient 109 may be held by head support pad 107 at a level lower than the body/torso of the patient 109, which corresponds to the natural physiology of the human bodies. The patient 109 may utilize the facial hole 113 to breathe or see while facing downward in the prone position. Further, the flexibility of the pulmonary prone bed 100 reduces strain/pain on the back of the patient 109 by allowing the legs of the patient 109 to be angled downward while resting in the prone position. Accordingly, by increasing the comfort and ability of the patient 109 to breathe and remove nasal secretions while lying in the prone position, the pulmonary prone bed 100 described herein reduces the likelihood of the patient 109 developing Hospital-Acquired Pneumonia (HAP), also known as nosocomial pneumonia.

Although described in relation to reducing the likelihood of HAP, the pulmonary prone bed 100 described herein may also be used in other therapeutic/medical contexts. For example, some patients 109 recovering from orthopedic injuries or procedures may benefit from resting in the prone position. Since the pulmonary prone bed 100 described herein allows patients 109 to rest more comfortably in the prone position in comparison to traditional beds, orthopedic patients 109 may also benefit from the assistance provided by the pulmonary prone bed 100.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A pulmonary prone bed, comprising:

a bed frame, including:

an upper section designed to accommodate a torso and a head of a patient, a middle section designed to accommodate upper legs of the patient, a lower section designed to accommodate lower legs of the patient, a first joint having (1) a first end configured to couple to a first end of the upper section, (2) a second end configured to couple to a first end of the middle section, and (3) a pivoting portion positioned between the first and second ends of the first joint, and a second joint having (1) a first end configured to couple to a second end of the middle section, (2) a second end configured to couple to a first end of the lower section, and (3) a pivoting portion positioned between the first and second ends of the second joint, wherein the pivoting portions of the first and second joints pivot such that the lower section is placed at a first height and the upper section is placed at a second height that is higher than the first height such that the lower legs of the patient are resting along the lower section at the first height and the torso of the patient is resting along the upper section at the second height to alleviate stress on a patient while lying in the prone position; and wherein the first and second joints are configured to expand and retract in a lengthwise direction such that (1) a distance between the first end of the first joint and the pivoting portion of the first joint is adjustable in the lengthwise direction, (2) a distance between the pivoting portion of the first joint and the second end of the first joint is adjustable in the lengthwise direction, (3) a distance between the first end of the second joint and the pivoting portion of the second joint is adjustable in the lengthwise direction, and (4) a distance between the pivoting portion of the second joint and the second end of the second joint is adjustable in the lengthwise direction.

2. The pulmonary prone bed of claim 1, further comprising:

a body mattress to support the torso, upper legs, and lower legs of the patient; and a first head support pad to support the head of the patient.

3. The pulmonary prone bed of claim 2, wherein the body mattress is placed along the upper, middle, and lower sections of the bed frame and the head support pad is placed along the upper section of the bed frame.

4. The pulmonary prone bed of claim 3, wherein the body mattress is composed of padding used to cushion the torso, upper legs, and lower legs of the patient while resting on the bed frame.

5. The pulmonary prone bed of claim 3, wherein the head support pad is composed of padding used to cushion the head of the patient while resting on the bed frame, wherein the padding is arranged to create a facial hole between a top surface of the head support pad and a bottom surface of the head support pad such that the eyes, nose, and mouth of the patient are exposed to air while the face of the patient is depressed into the top surface of the head support pad.

6. The pulmonary prone bed of claim 5, wherein the first joint expands or retracts such that a chin of the patient extends over the body mattress and onto the head support pad such that the forehead and chin of the patient are resting on the first-head support pad while the eyes, nose, and mouth of the patient are exposed within the facial hole while in the prone position.

7. The pulmonary prone bed of claim 6, wherein a depth of the body mattress is greater than a depth of the first head support pad, wherein the depth of the first head support pad is defined as the distance between the top and bottom surfaces.

8. The pulmonary prone bed of claim 2, wherein the first head support pad is separate from the body mattress.

9. The pulmonary prone bed of claim 2, wherein the body mattress and the first head support pad are coupled to the bed frame, wherein the body mattress and the first head support pad are expandable with the lengthwise direction expansion of the bed frame.

10. The pulmonary prone bed of claim 1, further comprising:

a set of support legs coupled to the bed frame, wherein the set of support legs support the bed frame and the patient while the pulmonary prone bed is standing on a floor.

11. The pulmonary prone bed of claim 10, further comprising:

a plurality of wheels, wherein each wheel in the plurality of wheels is coupled to a support leg in the set of support legs to allow support legs to move in relation to each other while the bed frame expands or contracts using the first and second joints.

12. A pulmonary bed frame comprising:

an upper section designed to accommodate a torso and a head of a patient, a middle section designed to accommodate upper legs of the patient, a lower section designed to accommodate lower legs of the patient, a first side edge and an opposing second side;

a first joint having (1) a first end configured to couple to a first end of the upper section, (2) a second end configured to couple to a first end of the middle section, and (3) a pivoting portion positioned between the first and second ends of the first joint, a second joint having (1) a first end configured to couple to a second end of the middle section, (2) a second end configured to couple to a first end of the lower section, and (3) a pivoting portion positioned between the first and second ends of the second joint, a body mattress coupled to the pulmonary bed frame, and for supporting the torso, upper legs, and lower legs of the patient, and a head support pad coupled to the pulmonary bed frame, and for supporting the head of the patient, wherein the pivoting portions of the first and second joints pivot such that the lower section is placed at a first height and the upper section is placed at a second height that is higher than the first height such that the lower legs of the patient are resting along the lower section at the first height and the torso of the patient is resting along the upper section at the second height to alleviate stress on a patient while lying in the prone position;

wherein the first and second joints are configured to expand and retract in a lengthwise direction such that (1) a distance between the first end of the first joint and the pivoting portion of the first joint is adjustable in the lengthwise direction, (2) a distance between the pivoting portion of the first joint and the second end of the first joint is adjustable in the lengthwise direction, (3) a distance between the first end of the second joint and the pivoting portion of the second joint is adjustable in the lengthwise direction, and (4) a distance between the pivoting portion of the second joint and the second end of the second joint is adjustable in the lengthwise direction, wherein the body mattress and head support pad are both configured to expand and retract, as a whole, in the lengthwise direction with the pulmonary bed frame, as the first and second joints of the pulmonary bed frame expand and retract in the lengthwise direction.

13. The pulmonary bed frame of claim 12, further comprising:

wherein the body mattress is placed along the upper, middle, and lower sections of the bed frame and the head support pad is placed along the upper section of the bed frame, wherein the head support pad is composed of padding used to cushion the head of the patient while resting on the bed frame, wherein the padding is arranged to create a facial hole between a top surface of the head support pad and a bottom surface of the head support pad such that the eyes, nose, and mouth of the patient are exposed to air while the face of the patient is depressed into the top surface of the head support pad.

14. The pulmonary bed frame of claim 13, wherein the body mattress and the head support pad are coupled to the bed frame, wherein the body mattress and the head support pad are expandable with the expanding bed frame.

15. The pulmonary bed frame of claim 12, further comprising: a plurality of wheels, wherein each wheel in the plurality of wheels is coupled to a support leg in the set of support legs to allow support legs to move in relation to each other while the bed frame expands or contracts using the second joints.

16. The pulmonary bed frame of claim 12, wherein each of the first and second joints can expand and contract separately on each side of an axis of the pivoting portion of the joints.

17. The pulmonary prone bed of claim 1, wherein each of the first and second joints can expand and contract separately on each side of an axis of the pivoting portion of the joints.

18. A pulmonary prone bed, comprising:

a bed frame, including:

an upper section designed to accommodate a torso and a head of a patient, a middle section designed to accommodate upper legs of the patient, a lower section designed to accommodate lower legs of the patient, a first joint having (1) a first end configured to couple to a first end of the upper section, (2) a second end configured to couple to a first end of the middle section, and (3) a pivoting portion positioned between the first and second ends of the first joint, and a second joint having (1) a first end configured to couple to a second end of the middle section, (2) a second end configured to couple to a first end of the lower section, and (3) a pivoting portion positioned between the first and second ends of the second joint;

a body mattress having a first depth between a first top surface and a first bottom surface; and a head support pad having a second depth between a second top surface and a second bottom surface, wherein the first bottom surface and the second bottom surface are both supported by the bed frame, wherein the head support pad and the body mattress is one inseparable unit, and the second top surface is lower than the first top surface, such that the second depth is less than the first depth, wherein the pivoting portions of the first and second joints pivot such that the lower section is placed at a first height and the upper section is placed at a second height that is higher than the first height such that the lower legs of the patient are resting along the lower section at the first height and the torso of the patient is resting along the upper section at the second height to alleviate stress on a patient while lying in the prone position; and wherein the first and second joints are configured to expand and retract in a lengthwise direction such that (1) a distance between the first end of the first joint and the pivoting portion of the first joint is adjustable in the lengthwise direction, (2) a distance between the pivoting portion of the first joint and the second end of the first joint is adjustable in the lengthwise direction, (3) a distance between the first end of the second joint and the pivoting portion of the second joint is adjustable in the lengthwise direction, and (4) a distance between the pivoting portion of the second joint and the second end of the second joint is adjustable in the lengthwise direction.

19. The pulmonary prone bed of claim 1, wherein each of the first and second joints can expand and contract separately on each side of an axis of the pivoting portion of the joints.

* * * * *